United States Patent [19]

McGrew

[11] 3,938,201

[45] Feb. 17, 1976

[54] VENTILATOR FOR A TOILET BOWL

[76] Inventor: Dan McGrew, 533 Crockett St., Grand Prairie, Tex. 75050

[22] Filed: Nov. 4, 1974

[21] Appl. No.: 520,663

[52] U.S. Cl. ..... 4/213; 4/211; 4/218

[51] Int. Cl.[2] ..... E03D 9/04; A47K 13/00

[58] Field of Search ..... 4/211–218, 4/100, DIG. 1

[56] References Cited

UNITED STATES PATENTS

| | | | |
|---|---|---|---|
| 1,911,032 | 5/1933 | Minkler | 4/213 |
| 1,972,774 | 9/1934 | Hartwell | 4/213 |
| 2,388,990 | 11/1945 | Nelson et al. | 4/100 X |
| 2,724,840 | 11/1955 | Scott et al. | 4/216 |
| 2,777,137 | 1/1957 | McFadden | 4/213 |
| 2,778,033 | 1/1957 | Majauskas | 4/213 |
| 2,847,682 | 8/1958 | Shay | 4/213 |
| 3,192,539 | 7/1965 | Martz | 4/218 |
| 3,230,552 | 1/1966 | Schulz | 4/218 |
| 3,273,170 | 9/1966 | Wheeler | 4/72 |

*Primary Examiner*—Henry K. Artis

*Attorney, Agent, or Firm*—Howard E. Moore; Gerald G. Crutsinger

[57] ABSTRACT

Ventilator apparatus to remove foul air and objectionable odors from a toilet comprising a vent duct manifold molded into the rear portion of the toilet bowl rim and communicating with a laterally extending coupling. The coupling communicates with a vent stack of the sewer in order to vent the manifold. The vent stack communicates with a blower which draws foul air out of the toilet bowl and discharges the air to atmosphere. The intake opening of the vent duct is positioned to prevent entry of water thereinto by a lip extending downwardly on the front edge of the vent duct.

5 Claims, 4 Drawing Figures

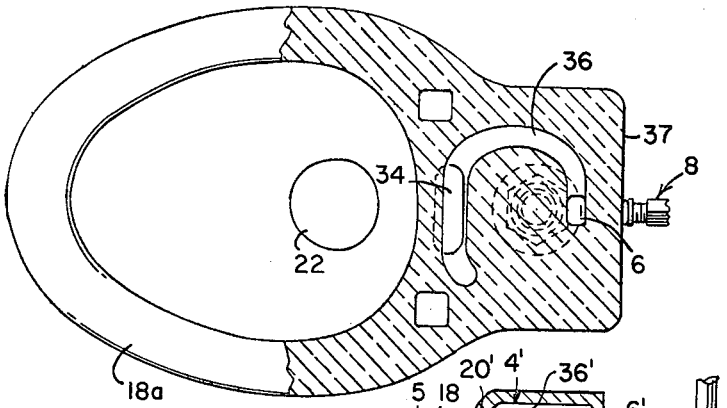
Fig. 2
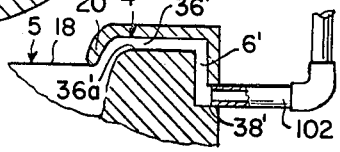
Fig. 4
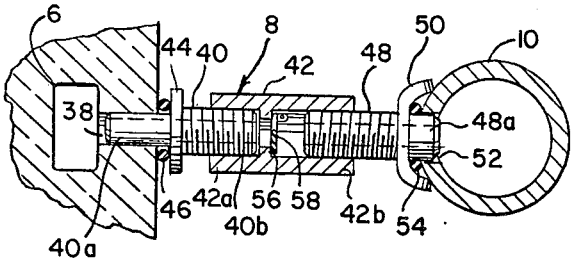
Fig. 3
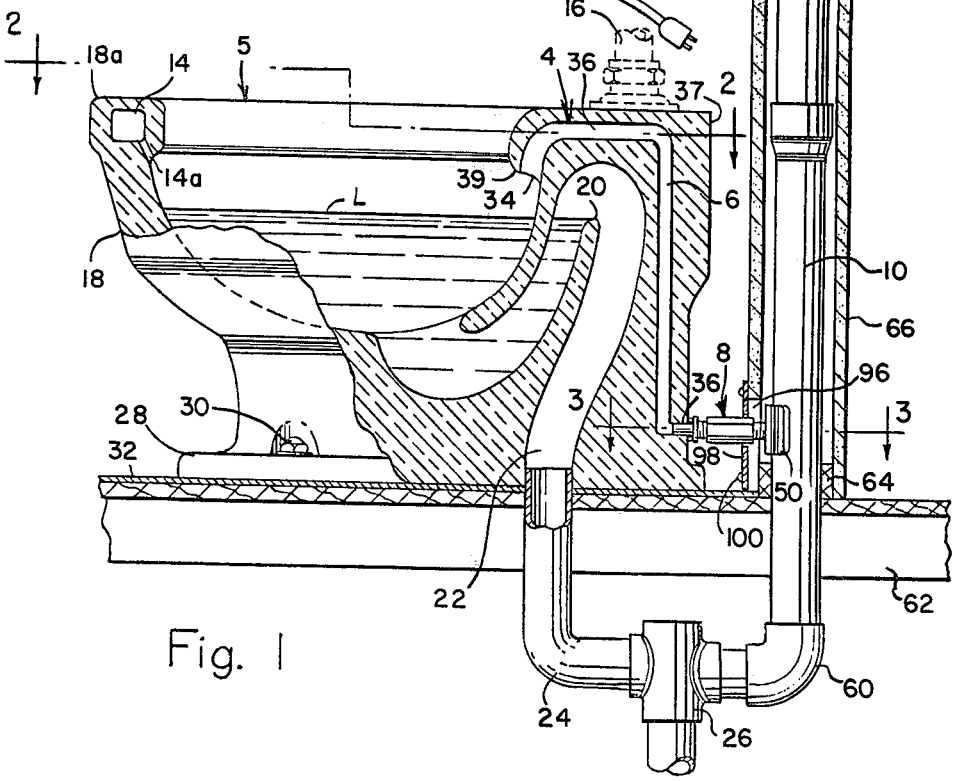
Fig. 1
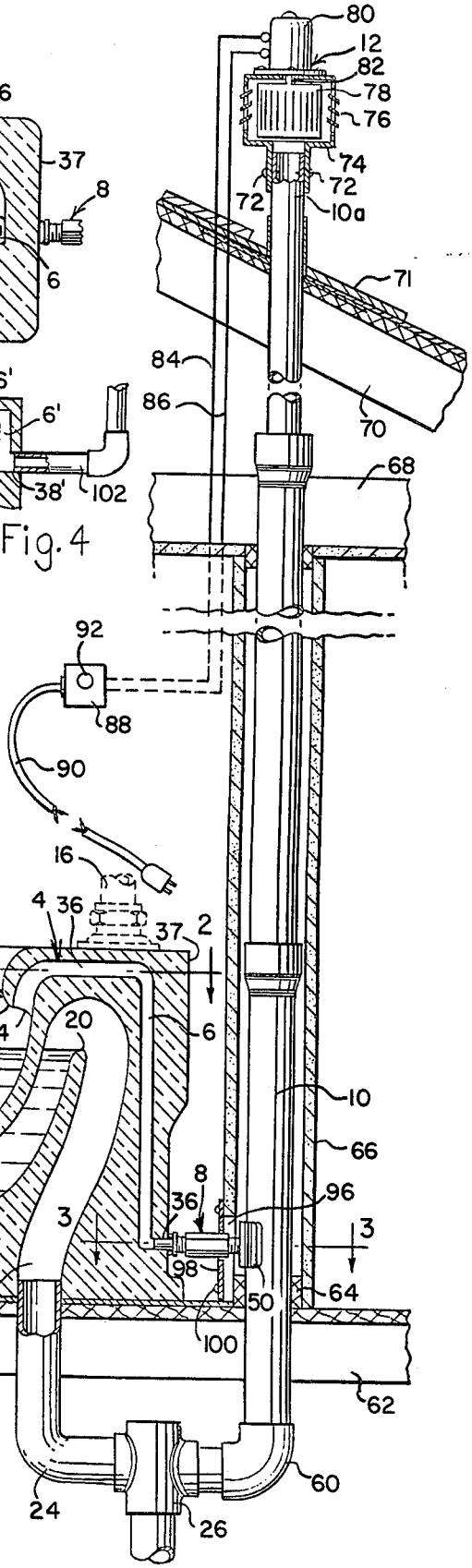

VENTILATOR FOR A TOILET BOWL

BACKGROUND OF THE INVENTION

Several types of odor removing devices have been devised heretofore to remove foul air from the bathroom. However, ventilation devices heretofore devised have not been molded into the rear portion of a toilet bowl to prevent entry of water and foreign material into the intake opening thereinto. Thus, foreign matter may collect in the cracks and slots formed in a device attached to the toilet making the devices difficult to clean and unsanitary.

Some devices heretofore devised contain switches within the seat which makes them potentially dangerous because of the possibility that the occupant of the toilet could be electrocuted.

The devices heretofore devised for ventilation of toilet bowls have comprised attachments which are not durable because of the many parts which corrode and oxidize due to the presence of water and other fluids. In addition, attachments to the toilet bowl are not practical for installation after construction of the building because ventilator ducts must be installed in unaccessible areas.

SUMMARY OF INVENTION

I have devised a ventilation system for removing odors from the toilet in which an intake opening is integrally molded into the toilet bowl and positioned to prevent entry of liquid thereinto. The intake opening is formed in a manifold which has a downwardly extending lip to facilitate cleaning and to prevent entry of liquid into the ventilation system making the vent sanitary and easily cleaned.

A ventilation passage communicating with the manifold of the toilet is connected by an adjustable coupling to the existing vent stack of the sewer system or to a separate vent pipe, to provide an exhaust conduit and simplify installation.

A squirrel cage exhaust fan is mounted adjacent the upper end of the vent stack to draw the foul air from the toilet bowl, making operation quiet and the fan easy to maintain because of the accessibility of the fan.

A primary object of the invention is to provide a method of removing foul odors directly from the toilet, thus preventing entry to the bathroom.

Another object of the invention is to provide a safe, efficient method of removing odors directly from the source without subjecting people using the device to the dangers of electrical shock.

A further object of the invention is to clean the air quickly of odors by drawing foul air from the point of inception.

Other and further objects of the invention will become apparent upon referring to the detailed description hereinafter following, and to the drawings annexed hereto.

DESCRIPTION OF THE DRAWING

Drawings of a preferred embodiment of the invention are annexted hereto so that the invention may be better and more fully understood, in which:

FIG. 1 is a fragmentary cross-sectional view of the ventilation system diagrammatically illustrating the exhaust fan and switch;

FIG. 2 is a cross-sectional view taken along line 2—2 of FIG. 1;

FIG. 3 is a cross-sectional view taken along line 3—3 of FIG. 1.

FIG. 4 is a partial fragmentary view of a modified form.

Numeral references are employed to designate like parts throughout the various figures of the drawing.

DESCRIPTION OF A PREFERRED EMBODIMENT

A vent 4, as illustrated in FIG. 1 of the drawing, is molded into the rear portion of the toilet 5 and communicates with air passage 6. Coupling 8 connects air passage 6 with the existing vent stack 10 of the sewer system (not shown) which allows the foul air in toilet 5 to be drawn upward through the vent stack 10 by an exhaust fan 12 secured to the upper end 10*a* of vent stack 10. The foul air is then exhausted into the surrounding atmosphere exteriorly of the building.

Toilet 5 has a bowl 18 having a water inlet passage 14 formed in rim 18 *a* with a plurality of aperatures 14 *a* spaced throughout for guiding fresh water into the toilet bowl 18 to push water L out of the bottom of the bowl 18. The water L is held in the bowl 18 by the upwardly extending protrusion 20 in water passage 22. When additional water enters bowl 18 from water passages 14 and 16 the water L in bowl 18 is pushed outward over protrusion 20.

A vacuum is created by the water L falling over protrusion 20 which draws the remaining water L from the bowl 18 thus cleaning the toilet 5 of all foreign matter. The water L then passes into the existing sewer system.

The toilet 5 has a flanged base 28 formed on the bottom thereof and is secured by anchor bolts 30 to the floor 32.

The vent 4 is formed in the upper rear portion of toilet 5. Vent 4 comprises an intake passage 34 having one end communicating with the interior of the toilet bowl 18 and the other end communicating with manifold 36, as illustrated in FIGS. 1 and 2. Manifold 36 is a hollow passage communicating with air passage 6 which extends vertically down the rear wall 37 of the toilet bowl 18. In the preferred embodiment the manifold 36 forms a semi-circular passage between intake 34 and air passage 6. At the bottom of passage 6 an opening 38 is formed through rear wall 37 communicating with the coupling 8. The intake passage 34 has a lip 39 formed in the front portion to prevent liquid and foreign matter from entering the vent 4 thus making vent 4 easy to clean and keep sanitary. Vent 4 has a highly polished and glazed surfaces to facilitate cleaning.

Coupling 8 comprises a hollow tubular member 40 having a first end 40*a* extending into opening 38 and a second end 40*b* having external threads secured to internally threaded sleeve 42. Tubular extension 40 has an annular shoulder 44 rigidly secured thereto. O-ring 46 is secured between the outer surface of rear wall 37 of toilet 5 and the annular shoulder 44 for forming a seal about passage 38. Sleeve 42 has a second end 42*b* internally threaded to accept externally threaded tubular member 48 having a saddle flange 50 secured to end 48*a* thereof which extends into passage 52 formed in the vent stack 10. O-ring seal 54 is urged into sealing engagement with stack 10 when coupling 8 is installed. Sleeve 42 has left and right hand threads so that as sleeve 42 is turned, tubular member 40 and tubular member 48 move inwardly and outwardly together. When installing coupling 8, sleeve 42 is turned, extending tubular members 40 and 48 outwardly from the center thereof sealing about opening 38 and passage 52 by O-ring seals 46 and 54.

Sleeve 42 has a shoulder 56 formed on the interior thereof to limit movement of flapper valve 58. Flapper valve 58 is pivotally secured to the interior of sleeve 42 such that it is closed under normal conditions and when a vacuum is formed by exhaust fan 12 flapper valve 58 will open toward the stack 10 permitting a vacuum to be drawn on vent 4 and the interior of bowl 18. Flapper valve 58 prevents leakage of sewer gas back into the toilet 5 through vent 4 when there is no vacuum within vent stack 10.

Vent stack 10 is connected to a T-coupling 26 by elbow coupling 60 and extends through floor joist 62 and bottom plate 64 of the building structure. Vent stack 10 extends upwardly through wall 66 and passes into the attic through ceiling joist 68 and through rafters 70 to the top of roof 71. The vent stack 10, as illustrated in the preferred embodiment, acts as an exhaust conduit for the ventilation system 4; however, it should be appreciated that a separate exhaust conduit may be installed.

Exhaust fan 12 is mounted on upper end 10a of vent stack 10 by screws 72. Exhaust fan 12 comprises a housing 74 with louvers 76 formed therein to prevent rain from entering housing 74 and to allow the exhaust gases to exit from housing 74. Motor 80 is secured to a squirrel cage fan 78 by shaft 82. When motor 80 is energized a vacuum is drawn through vent stack 10 by the exhaust fan 12 and air from vent stack 10 is forced out of louvers 76.

Electrical conductors 84 and 86 connect motor 80 to a time delay opening switch 88 which is connected to a power source of 110 volts by means of conductor 90.

Time delay opening switch 88 is located adjacent the toilet 5 such that the occupant may turn the switch fan 12 on and adjust the number of minutes the fan will run by turning knob 92. The time delay opening switch 88 will then open the circuit to motor 80 after a predetermined number of minutes.

Operation of the hereinbefore described invention is as follows:

Installation may be achieved by cutting a small hole 96 in wall 66 near floor 32 allowing access to vent stack 10. Passage 52 is then cut into vent stack 10 allowing coupling 8 to be installed thereto. Toilet 5 is then secured to floor 32 in the proper position by anchor bolts 30. Coupling 8 having tubular members 40 and 48 extending into passages 38 and 52 respectively is then extended by turning sleeve 42 so as to extend tubular members 40 and 48 outwardly from the center thereof until a seal is made around passages 38 and 52.

As access panel 98 is secured by screws 100 to wall 66 over hole 96.

The exhaust fan 12 is then secured to the upper end 10a of vent stack 10 and wired to an appropriate position adjacent the toilet 5.

When it is desired to remove odors from toilet 5, motor 80 is energized by turning knob 92 of time delay opening switch 88 to the on position. Exhaust fan 12 forms a vacuum in vent stack 10 opening flapper valve 58 and creating a vacuum in air passage 6 and vent 4. Odors are then vacuumed through intake 34, through manifold 36, and into air passage 6. The odors then pass through vent stack 10, through exhaust fan 12, and are exhausted through louvers 76 into the atmosphere.

A modified form of the vent 4' is illustrated in FIG. 4 of the drawings. The manifold 36' extends above the bowl rim 18 of toilet 5 having protrusion 20' formed above the rim 18 such that the lower wall 36a' of manifold 36' is above the rim 18 so that water cannot enter the vent 4'. Air passage 6' communicates between manifold 36' and passage 38'. A conduit 102 extends into passage 38' and communicates with fan 12 to drawn the foul air from the toilet 5.

It should be readily apparent that the apparatus herein described accomplishes the objects of the invention hereinbefore discussed.

It should be appreciated that other and further embodiments of the invention may be devised without departing from the basic concept thereof.

Having described my invention, I claim:

1. Ventilating apparatus comprising a toilet bowl having a manifold formed in the upper rear portion thereof, such that a first end communicates with the inner portion of said toilet bowl and the other end communicates with the exterior rear wall of said toilet bowl; a lip formed above and adjacent the first end of the manifold; a vent stack; coupling means to connect said manifold to the vent stack; a flapper valve element pivotally secured to the interior wall of the coupling means, said flapper valve element being movable toward the vent stack by air pressure; a shoulder to limit the movement of said flapper in a direction away from said vent stack; an exhaust fan secured to the upper end of said stack; a time delay opening switch; conductor means to connect said switch to the exhaust fan; a power source connectable to said switch.

2. The combination called for in claim 1 wherein the exhaust fan comprises a housing having louvers formed in the sides thereof secured to said vent stack; an electric motor having a rotatable shaft thereon, said shaft extending into said housing; and a fan secured to said shaft inside of said housing.

3. Ventilating apparatus comprising a toilet bowl having a manifold formed in the upper rear portion thereof, such that a first end communicates with the inner portion of said toilet bowl and the other end communicates with the exterior rear wall of said toilet bowl; a lip formed above and adjacent the first end of the manifold; a vent stack; coupling means to connect said manifold to the vent stack; an exhaust fan secured to the upper end of said stack; a time delay opening switch; conductor means to connect said switch to the exhaust fan; a power source connectable to said switch, wherein said coupling means comprises: a sleeve; a first hollow tubular member having one end communicating with said manifold and the other end threadedly secured to said sleeve; a second hollow tubular member having one end threadedly secured to said sleeve and the other end communicating with the vent stack, such that when the sleeve is turned in a first direction the first and second hollow tubular members move outwardly from the center of the sleeve and when turned in a second direction move inwardly toward the center of the sleeve; an annular shoulder formed about the first hollow tubular member; a flange formed about the second hollow tubular member; and seal means secured to each end of said tubular members.

4. The combination called for in claim 3 wherein the seal means comprises a first O-ring positioned about the first hollow tubular member between the manifold and the annular shoulder; and a second O-ring positioned about the second hollow tubular member between the flange and vent stack.

5. The combination called for in claim 3 with the addition of: a time delay opening switch and conductor means to connect said switch to the exhaust fan.

* * * * *